United States Patent [19]

Kritz

[11] 4,450,542

[45] May 22, 1984

[54] MULTIPLE BEAM LENS TRANSDUCER FOR SONAR SYSTEMS

[75] Inventor: Jacob A. Kritz, Westbury, N.Y.

[73] Assignee: Sperry Corporation, New York, N.Y.

[21] Appl. No.: 354,973

[22] Filed: Mar. 5, 1982

[51] Int. Cl.[3] ..... H04R 17/00

[52] U.S. Cl. ..... 367/150; 310/335

[58] Field of Search ..... 367/141, 150, 152, 153, 367/155, 157; 310/334, 335, 337

[56] References Cited

U.S. PATENT DOCUMENTS

| | | | |
|---|---|---|---|
| 3,663,842 | 5/1972 | Miller | 367/150 |
| 3,687,219 | 8/1972 | Langlois | 367/150 |
| 3,776,361 | 12/1973 | Rolle | 367/150 |
| 3,800,276 | 3/1974 | Rishell | 367/150 |
| 3,866,711 | 2/1975 | Folds | 367/150 |
| 3,979,565 | 9/1976 | McShane | 367/157 |

OTHER PUBLICATIONS

*Doppler Sonar Velocity Log for Attack Submarines*, by Wapner et al., IEEE Position Location and Navigation Symposium, Atlantic City, N.J., Dec. 8–11, 1980.

*Primary Examiner*—Harold J. Tudor

*Attorney, Agent, or Firm*—Howard P. Terry; Ralph A. Johnston

[57] ABSTRACT

A compact apparatus for transmitting and receiving multiple sonar beams utilizes an acoustic lens to direct plane waves incident in desired directions to electroacoustic transducers positioned on spherical shell segments centered in the focal regions of the lens associated with the incident beams. The electroacoustic transducers transmit spherical waves that are transformed by the acoustic lens to plane waves emergent in the desired directions.

12 Claims, 2 Drawing Figures

MULTIPLE BEAM LENS TRANSDUCER FOR SONAR SYSTEMS

BACKGROUND OF THE INVENTION

1. Field of the Invention

The present invention relates generally to electroacoustic transducers employed in sonar systems, and more particularly to an electroacoustic transducer capable of accommodating multiple sonar beams.

2. Description of the Prior Art

Sonar systems utilize narrow beams of sound energy projected in certain desired directions from a marine vehicle, and receive reflected energy from these directions, as described, for example, in U.S. Pat. No. 3,257,638 for Doppler Navigation Systems, issued to Jack Kritz and Seymour D. Lerner in 1966. Conventionally, these beams are produced by vibrating piezoelectric discs with diameters that are large compared to the wavelength of the soundwave propagated or to be received. When multiple beams are utilized, the transducer assembly must be enlarged to accommodate the multiplicity of necessary elements. Multiple beam transducers of the prior art create installation difficulties, particularly on small ships, and provoke increased installation costs due to larger gate valves and stronger required structural supports. Thus, there is a need for relatively compact multiple beam transducers that will facilitate installation and mitigate attendant costs.

SUMMARY OF THE INVENTION

In accordance with the principles of the present invention, plane waves incident on an acoustic lens from a particular direction are directed to a focal region in the focal plane of the lens. An electroacoustic transducer constructed over a spherical shell segment centered at a point in the focal region provides a large surface for intercepting substantially all the coustic energy directed towards the focal region. During transmission, this electroacoustic transducer radiates spherical waves as though the transducer's associated focal region were the source. Such a spherical wave is transformed by the acoustic lens to a plane wave in the direction corresponding to the focal region from which the spherical wave appears to have originated.

In one preferred embodiment, the lens is doubly concave, solid polystyrene, bonded to an inner medium of silicone rubber. Three piezoelectric crystal transducers, each of which is 15 degrees off the central lens axis, are placed to receive or transmit beams. Interposed between each crystal and the inner medium of silicone rubber, is a metallic window followed by a plastic matching section.

DESCRIPTION OF THE PREFERRED EMBODIMENTS

Figure 1:
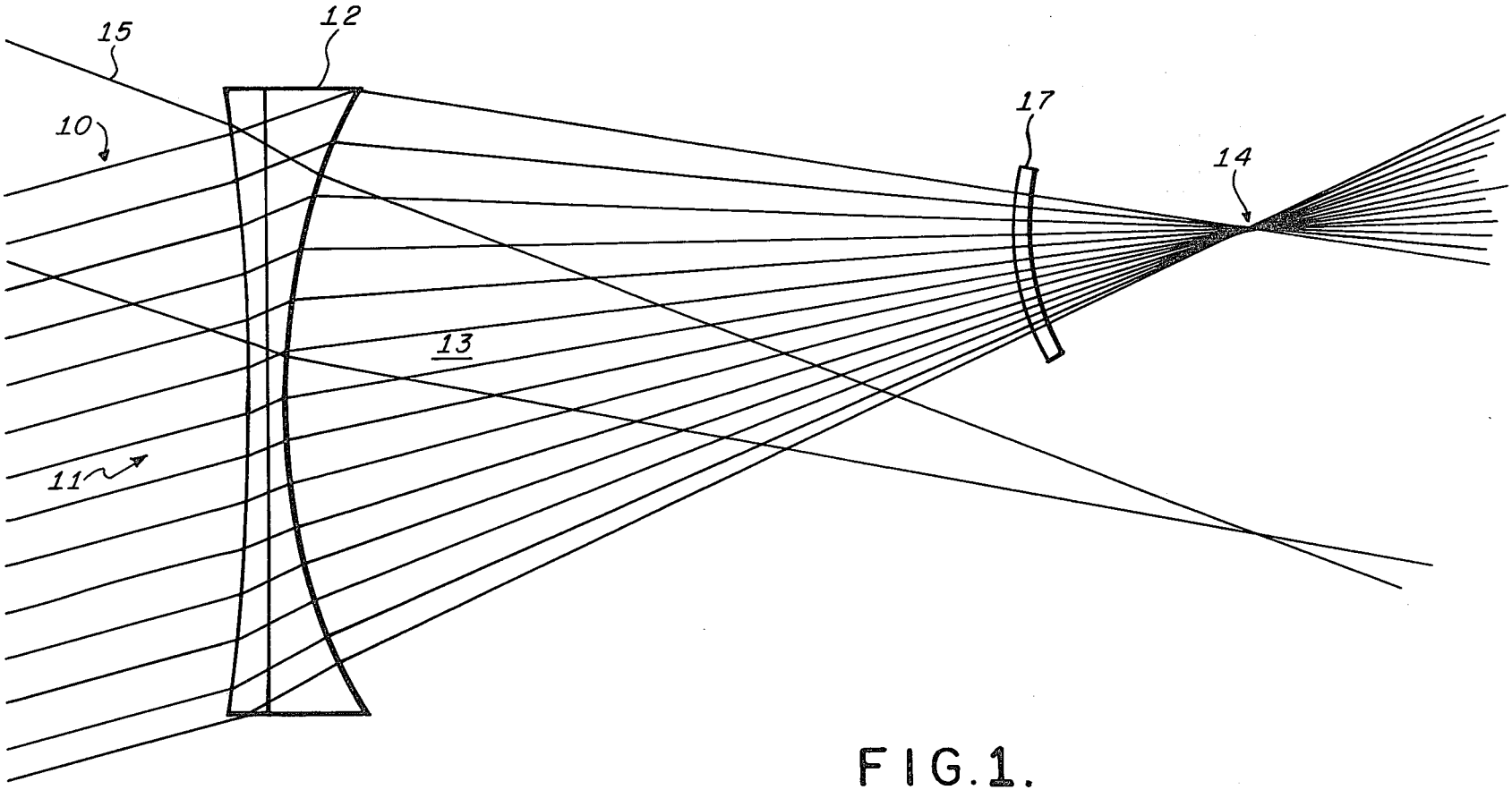
FIG. 1 is a schematic diagram of a doubly concave acoustic lens and associated spherical shell segment electroacoustic transducer, with a superposed ray diagram illustrating the focusing action of the lens.

The invention describes a means of constructing a multiple beam transducer that uses a single aperture in the form of an acoustic lens which provides the required aperture to wavelength ratio. A ray diagram depicting the focusing action of an acoustic lens is shown in FIG. 1. Parallel rays of an incident plane wave 10, propagating in the water mdium 11, impinge on the acoustic lens 12. To focus an incident plane wave, the lens is chosen doubly concave and constructed of a medium wherein the sound velocity is greater than the sound velocity in the water and the other adjacent medium 13. The focusing action results from the beam's being first bent away from the normal to the surface of the lower refractive index lens as it enters the lens, and then upon emergence from the lens, being bent towards the normal. Accordingly, incident plane sound wave 10 is focused to point 14 by the lens thus constructed. Conversely, a point source at 14 illuminating the lens with a sound wave will cause the projection of a plane wave depicted by the parallel rays 10. Characteristic of a lens constructed in this fashion is a unique correspondence between the direction of incidence of a plane wave, and the associated focal point in the focal plane of the lens. Simply, collimated beams incident from different directions have different focal points. For example, the plane wave incident from direction 15 will be focused at point 16. Thus, a multiplicity of such focal points lie in the focal plane, each of which can define a different beam direction for reception or projection of sound waves. A multiplicity of small electroacoustic transducers placed at different focal points can then be used to transmit and receive sound beams such that the beam width is characterized by the lens diameter.

A major deterrent to the implementation of this arrangement is the inability of the small transducers to operate at significant power levels. The sound intensity (watts per unit area) in medium 13 in the vicinity of the transducer is intense because of the small transducer surface area, causing cavitation and disruption of the medium. In addition, the heat dissipation produced by transducer losses is confined to the small transducer surface, causing high temperatures to be generated if significant electrical power is supplied. In this invention, larger transducers having significant surface area are employed, and are placed forward of the focal points. An electroacoustic transducer 17, is shaped in the form of a segment of a spherical shell, the radius of which is at the desired focal point. All rays impinging on 17 are in phase at the surface, since all surface elements are the same distance from the focal point by virtue of its spherical shape. All the acoustic energy received by lens 12 is thus available for conversion to electrical energy by the transducer. Conversely, when acting as a transmitter, the transducer radiates spherical waves as though the focal point 14 were the source. A further advantage obtained by this arrangement is that small changes in the position of the focal point do not cause drastic changes in the performance, since all rays are still encompassed by the transducer with only small out of phase interference. With small transducer elements directly at the focal point, small changes in focal point location can cause large changes in the captured energy. A further advantage is realized in the depth of the transducer being reduced, since the distance in medium 13 behind the lens need not extend to the focal plane.

Figure 2:
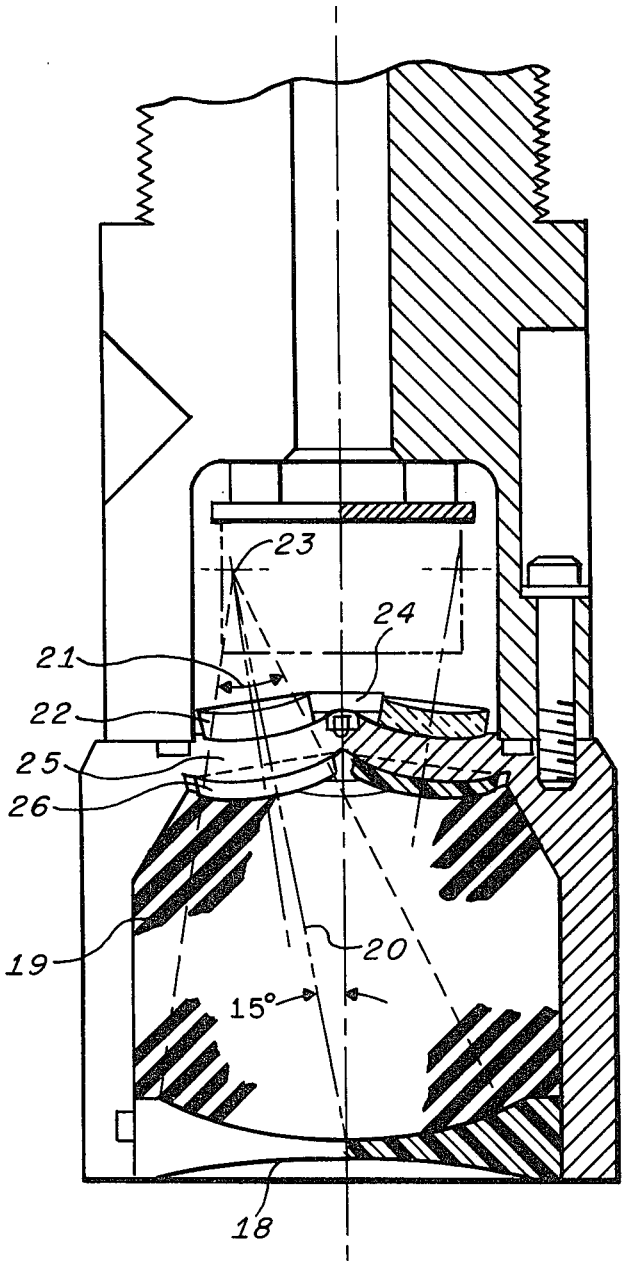
FIG. 2 is a cross sectional view of a preferred embodiment of the invention.

A typical design embodying this invention is shown in FIG. 2. A solid lens 18, of cross linked polystyrene, 3.375 inches in diameter, 0.187 inches center thickness, with external radius of 13.3 inches, and internal radius of 3.74 inches is in contact with water on its outer surface and bonded on its inner surface to a medium 19, of silicone rubber. The arrangement shown provides for three transmitting or receiving beams each 15 degrees off the len's central axis. The low sound speed in rubber produces a short focal length 20, of 5.52 inches, thus further diminishing the assembly depth. The subtended angle 21 is 37 degrees. Three spherical shell segment piezoelectric crystals, one of which is crystal 22, centered at focal points, one of which is focal point 23, of outer radius 1.587 inches, and of such thickness that they resonate at 400 kHz, are bonded to a metal support 24. Interposed between each crystal and the silicone rubber medium is first, a metallic window 25, followed by a plastic matching section 26. The metallic window is an aluminum spherical shell segment with thickness an integral multiple of a half wave length, in this case 0.311 inches. The window provides both structural strength and heat transport for the crystals, and is essentially transparent at the operating frequency. The transparency, that is, the negligible effect upon the transmission of waves follows from the standard sound transmission coefficient formula for waves traversing two boundaries (see, for example, Fundamentals of Acoustics, page 149 to 153, by Kinsler and Frey, Wiley, 1950). The matching section 26, is also a spherical shell segment, with thickness equal to an odd multiple of a quarter wavelength, in this embodiment a quarter wavelength, 0.065 inches. The matching section provides favorable electrical characteristics when measured at the electrical terminals of the crystals by transforming the low acoustic impedance of the rubber to a higher value for presentation to the crystals. Essentially, two purposes are served by the matching section: it broadens bandwidth, and increases efficiency of the transducer (see, The Effect of Backing and Matching on the Performance of Piezoelectric Ceramic Transducers, by George Kossoff, IEEE Transactions on Sonics and Ultrasonics, Volume SU-13, No. 1, March 1966).

While the invention has been described in its preferred embodiments, it is to be understood that the words which have been used are words of description rather than limitation and that changes may be made within the purview of the appended claims without departing from the true scope and spirit of the invention in its broader aspects.

I claim:

1. An apparatus for transmitting and receiving a plurality of sonar beams comprising:

lens means having a central axis and a focal surface, for converting incident plane sound waves to sound waves that converge at a focal region in said focal surface such that plane waves incident in different predetermined directions converge to different focal regions, and for converting sound waves emitted from said focal regions to plane sound waves radiating from said lens means in said predetermined directions, and a plurality of electroacoustic transducers, configured as segments of spherical shells, said spherical shells having centers in said focal regions, said transducers disposed between said lens means and said centers to receive focused sound waves.

2. Apparatus as described in claim 1 wherein said lens means includes a doubly concave acoustic lens constructed of a material with an acoustic propagating velocity that is greater than the acoustic propagating velocity of water, and an acoustic propagating medium having an acoustic propagating velocity that is less than said acoustic propagating velocity of said lens material, positioned between said lens and said plurality of acoustic transducers.

3. Apparatus as described in claim 2 further including:

window means positioned between said transducers and said acoustic propagating medium, for transmitting acoustic signals, transporting heat, and providing structural strength, and matching means positioned between said window means and said acoustic propagating medium for providing an acoustic impedance match between said window means and said acoustic propagating medium.

4. Apparatus as described in claim 3 wherein said doubly concave acoustic lens is comprised of polystyrene.

5. Apparatus as described in claim 4 wherein said acoustic propagating medium is comprised of silicone rubber.

6. Apparatus as described in claim 5 wherein said window means is comprised of a plurality of spherical shell segments having thicknesses that are an integral multiple of a half wavelength of an incident sound wave, and said matching means is comprised of a plurality of spherical shell segments having thicknesses that are an odd multiple of a quarter wavelength of said incident sound wave.

7. Apparatus as described in claim 6 wherein said window means is comprised of metal.

8. Apparatus as described in claim 7 wherein said matching means is comprised of plastic.

9. Apparatus as described in claim 8 wherein said metal is comprised of aluminum.

10. Apparatus as described in claim 9 wherein said plastic is comprised of epoxy.

11. Apparatus as described in claim 1, 2, 3, 4, 5, 6, 7, 8, 9, or 10 wherein each of said transducers is comprised of a piezoelectric crystal.

12. Apparatus as described in claim 11 wherein said piezoelectric crystals are three in number, each positioned 15 degrees off said central axis of said lens means.

* * * * *